United States Patent [19]

Megna

[11] 4,335,732

[45] Jun. 22, 1982

[54] HAIR CURLING IRON

[76] Inventor: Salvatore Megna, 3721 Fair Oaks Blvd., Sacramento, Calif. 95825

[21] Appl. No.: 228,573

[22] Filed: Jan. 26, 1981

[51] Int. Cl.[2] ..... A45D 24/10

[52] U.S. Cl. ..... 132/123; 132/129

[58] Field of Search ..... 132/123, 129; 15/23

[56] References Cited

U.S. PATENT DOCUMENTS

| | | | |
|---|---|---|---|
| 2,244,068 | 6/1941 | Kay | 132/129 |
| 3,150,393 | 9/1964 | Taylor et al. | 15/23 |
| 3,260,269 | 7/1966 | Zurndorfer | 132/123 |

*Primary Examiner*—G. E. McNeill

*Attorney, Agent, or Firm*—Fulwider, Patton, Rieber, Lee & Utecht

[57] ABSTRACT

A hair curling iron with retractable brushes having a handle, a generally tubular body secured at its one end to the handle and with a side wall containing a plurality of wall openings, a plurality of bars disposed longitudinally within the body with bristles extending in a generally radially outward direction for reciprocating movement through the wall openings, supports positioned substantially within the body toward each of its distal ends and beyond the bars for longitudinal movement with respect to the body, a plurality of actuator pins fixedly secured to each support and extending longitudinally inward toward the bars at a preselected angle relative to the bars for slidably engaging the bars and moving them in a similar generally radial direction in response to the movement of the supports in a similar longitudinal direction, and a tie rod slidably disposed within the body in longitudinal, coaxial alignment with the body and fixedly secured to the supports for causing their simultaneous longitudinal movement. A plurality of brush guide pins are fixedly secured to the body and extend in a generally radially inward direction for slidably engaging and restraining longitudinal movement of the bars. A manually operable sleeve externally encircles the body and engages one of the supports for moving the supports toward one end of the body for retraction of the bristles through the wall openings, and a spring applies a biasing force on the support directed toward the other end of the body for automatically returning the supports to a position with the bristles extended. The bars are positioned sufficiently, radially offset from the longitudinal axis of the body to avoid their contact with the tie rod when the bars are moved inward, and offset lugs extend laterally outward from the bars for slidably engaging the actuator pins at a sufficient distance from the bristles to avoid interference of the pins with the bristles.

20 Claims, 11 Drawing Figures

HAIR CURLING IRON

BACKGROUND OF THE INVENTION

The present invention relates generally to hair curling irons and, more particularly, to curling irons with retractable brushes.

It has long been known that the application of heat to hair will promote its setting, and conventional curling irons use this principle to set hair in curls. A section of hair desired to be curled is wound around a barrel of the curling iron, and the barrel is heated or a burst of steam or hot air is applied, to heat the hair and set the curl.

To facilitate grasping and winding of the section of hair, rows of bristles extending the length of the barrel may be provided. Use of bristles fixedly secured to the barrel, however, requires that the section of hair be unrolled to remove the barrel from the hair, and if the hair is still hot when unrolled, the hair cools at least partially in an unrolled and straigtened position. Consequently, the resultant curl is not as tight as desired. Even if the hair were allowed to cool completely before unrolling, which is unlikely due to the unreasonably long time such would require for setting a head of hair, once the cooled curl is unrolled, it is not resilient enough to return to its fully curled position.

A further problem encountered when unrolling the hair, either in a hot or cold state, is that the bristles tend to snag the hair and cause it to rewind about the barrel in a reverse direction. The pulling and resulting time delay can be damaging to the hair, reduce the tightness of the curl and be extremely frustrating to the curling iron user.

In an attempt to solve these problems, it has been proposed to manufacture a curling iron with bristles which may be retracted into the barrel so that the barrel can be conveniently removed from the hair without disturbing the curl. Since hair styling requires that curls be of a limited diameter, preferably about three-quarters of one inch or less, the space available within the barrel for the bristles when retracted and for the mechanism for retracting them, is limited. The problem is further complicated by the requirement that the bristles be of sufficient length to catch a minimum quantity of hair to achieve an acceptable curl thickness.

It will therefore be appreciated that there has been a significant need for a hair curling iron with fully retractable brushes which can fit within a barrel of limited diameter and provide bristles of a sufficient length that the curling iron may be effectively and efficiently used in the creation of popular hair styles. The present invention fulfills this need, and further provides other related advantages.

SUMMARY OF THE INVENTION

The present invention resides in a hair curling iron having a handle, a tubular body secured by its one end to the handle and with a radial side wall containing a plurality of wall openings, a plurality of retractable brushes disposed within the body with bristles extending in a generally radially outward direction, at least one selectively operable member disposed within the body for reciprocating longitudinal movement, and conversion means coacting with the member for covertting its reciprocating longitudinal movement into generally radially reciprocating movement of the bristles through the side wall openings to accomplish retraction or extension of the brushes.

Basically, and in general terms, the curling iron of the invention includes a plurality of slide actuators positioned toward each end of the body and disposed to move longitudinally with respect to the body for slidably engaging the brushes at a preselected angle for causing their movement in a similar generally radial direction in response to similarly directed longitudinal movement of the actuators. The curling iron also includes means for simultaneously moving the actuators in a similar longitudinal direction for retraction or extension of the brushes, and brush guides for restraining the longitudinal movement of the brushes with respect to the body as the actuators are moved.

The actuators are fixedly secured to supports positioned substantially within the body toward its distal ends and beyond the brushes, and the supports are disposed to move longitudinally with respect to the body. Also included are means for manually controlling the movement of the actuators in one longitudinal direction for retracting the bristles through the wall openings, and means for automatically moving the actuators in an other longitudinal direction for extending the bristles after once retracted.

More specifically, in the presently preferred embodiment of the invention, the actuators include pins, and the means for simultaneously moving the actuators include a member slidably disposed within the body, in longitudinal coaxial alignment with it, which extends between and is fixedly secured to the supports. The brushes are comprised of a plurality bars to which the bristles are rigidly secured, and the brush guides are positioned within and fixedly secured to the body and extend in a generally radial direction for slidably engaging the bars. The bars are positioned radially offset from the longitudinal axis of the body to provide increased travel of the brushes by avoiding their contact with the member.

The means for manually controlling the movement of the actuators for extension of the bristles comprises a sleeve extending external to the body and engaging the supports for moving them toward one end of the body, and the means for automatically moving the actuators for retraction of the bristles comprises a resilient member for applying a biasing force on the supports for moving them toward the other end of the body after the bristles have been retracted.

Offset lugs projecting laterally outward from the bars slidably engage the actuator pins away from the bristles to avoid their interference with the bristles. The support toward the handle end of the body has a plurality of arms extending generally radially outward beyond the side wall for attachment of the actuator pins external to the side wall.

Other features and advantages of the invention will become apparent from the following detailed description, taken in conjunction with the accompanying drawings.

BRIEF DESCRIPTION OF THE DRAWINGS

FIG. 6 is an enlarged, sectional view taken substantially along the line 6—6 of FIG. 2, and indicating more specifically the line along which FIG. 2 is taken;

DETAILED DESCRIPTION

Figure 1:
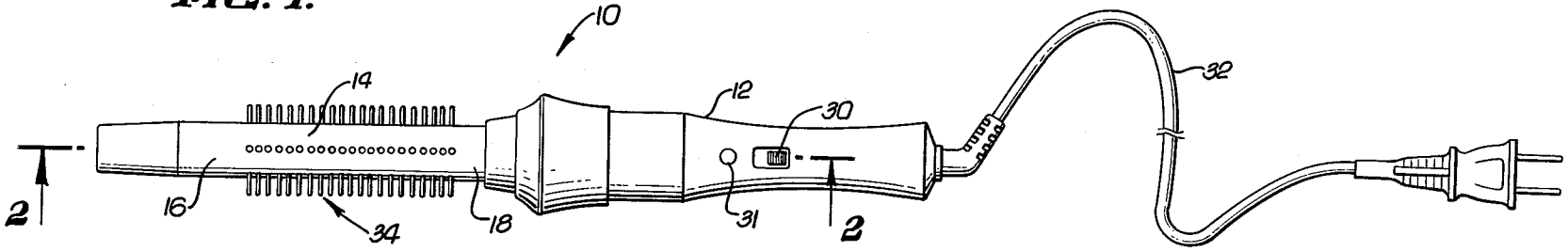
FIG. 1 is a plan view of a curling iron embodying the present invention.

As shown in the drawings for purposes of illustration, the present invention is embodied in a hair curling iron, indicated generally by reference numeral 10. The curling iron 10 includes a handle 12 and an elongated, tubular body 14 having a first distal end 16, a second distal end 18 and a radial side wall 20. The body 14 is rigidly attached along its second distal end 18 to the handle 12, and forms a longitudinal extension of the handle.

A pair of insulated electrical resistive heating elements 22 are enclosed within the body 14 and extend substantially the entire length of the body for conduction heating of the body. A section of hair (not shown) is wound around the body 14 by rotating the curling iron 10 about its longitudinal axis, and the heat trasnferred to the hair upon heating of the body promotes setting of the hair into a curl.

The side wall 20 has an exterior wall surface 24 which the hair contacts as it is wound around the body 14, and an interior wall surface 26 against which the heating elements 22 are held by a pair of retainers 28 formed as an integral part of the body. The heating elements 22 are spaced apart along the interior wall surface 26, generally opposite each other, to provide more uniform heating of the body 14. Application of electrical power to the heating elements 22, and hence the heat applied to the body 14 and the hair, is controlled by an electrical switch 30 mounted in the handle 12 for convenient operation by the curling iron user (not shown). An indication light 31 is also mounted in the handle, adjacent to the switch, for illumination when the switch is placed in an "ON" position. Electrical power is supplied to the switch 30 through an electrical cord and plug 32 extending from the handle 12.

In accordance with the invention, the curling iron 10 includes a plurality of retractable brushes 34 extending longitudinally within the body 14, a plurality of first end slide actuators 36 positioned toward the first distal end 16 and disposed to move longitudinally with respect to the body and to slidably engaging the brushes at a preselected angle $\alpha$ for causing their movement in a generally radial direction in response to the longitudinal movement of the first end actuators, a plurality of second end slide actuators 38 positioned toward the second distal end 18 and disposed to move longitudinally with respect to the body and to slidably engaging the brushes at the preselected angle for causing their movement in a generally radial direction in response to the longitudinal movement of the second end actuators, and a tie member 40 slidably disposed within the body and connecting the first and second end actuators together to provide for their simultaneous longitudinal movement. The actuators 36 and 38 are so oriented, with respect to each other, to cause similarly directed radial movement of the brushes 34 when the actuators are moved in the same longitudinal direction, and when simultaneously moved in the same direction, the actuators cause extension or retraction of the brushes.

The body 14 has a plurality of wall opening 42 spaced along its length, and the brushes 34 are comprised of elongated bars 44 with bristles 46 rigidly secured thereto and extending in a generally radially outward direction for reciprocating movement through the wall openings. To maintain proper alignment of the bristles 46 within the wall openings 42 and restrain longitudinal movement of the bars 44 as the actuators 36 and 38 are moved longitudinally for extension and retraction of the brushes 34, plurality of bar guides 48 are provided. The bar guides 48 extend in a generally radial direction, and are fixedly secured to the body 14 and slidably engage the bars 44.

The first and second end slides actuators 36 and 38 are fixedly secured to and carried by first and second end supports 50 and 52, respectively, which maintain the angular orientation of the actuators with respect to the brushes 34. The first end support 50 is positioned within the body 14 toward its first distal end 16 and beyond the brushes 34, and is longitudinally movable therein. The second end support 52 is positioned substantially within the body 14 toward its second distal end 18 and beyond the brushes, and is longitudinal movable therein. The tie member 40 holds the first and second end supports 50 and 52 in a fixed spatial relationship to each other, and causes the supports, and hence the actuators 36 and 38, to move simultaneously and in the same longitudinal direction in response to a longitudinal force applied to the second end support.

Figure 7:
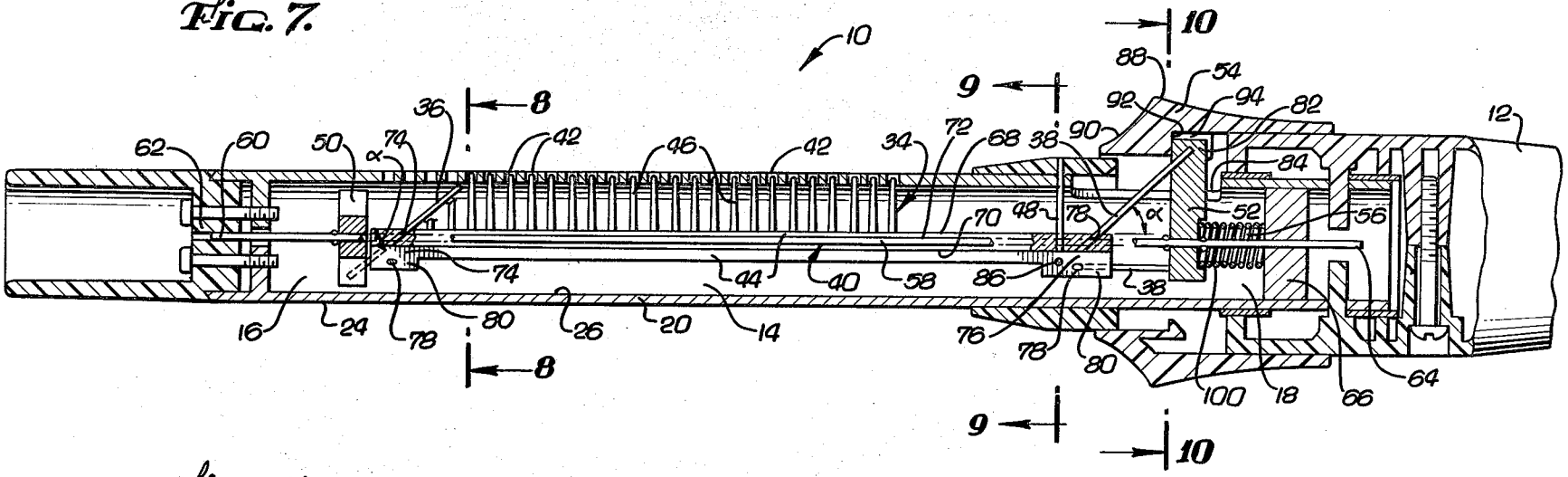
FIG. 7 is the same view of the curling iron as shown in FIG. 2, but with the brushes in a fully retracted position.
Figure 11:
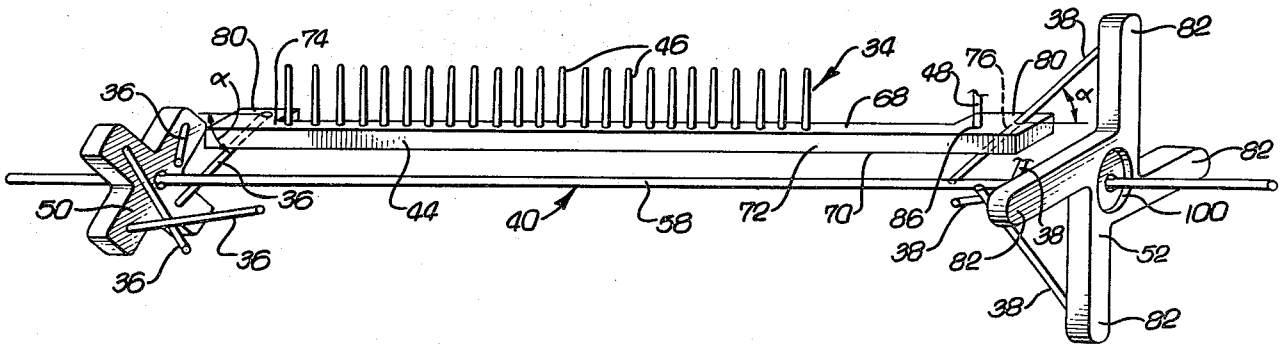
FIG. 11 is an enlarged, fragmentary, perspective view of the actuation mechanism of the curling iron shown in FIG. 1.

Retraction of the bristles 46 through the wall openings 42 is accomplished by movement of a manually operable control 54, extending external to the body 14 for easy grasping by the curling iron user. The control 54 engages the second end support 52 and applies a longitudinally outward force on it. In response to this force, the supports 50 and 52 move toward the second distal end 18, as do the actuators 36 and 38, and the angular relationship of the actuators to the brushes 34 converts this longitudinal movement into a radially inwardly directed force on the brushes, causing their retraction into the body 14 (FIG. 7).

Figure 2:
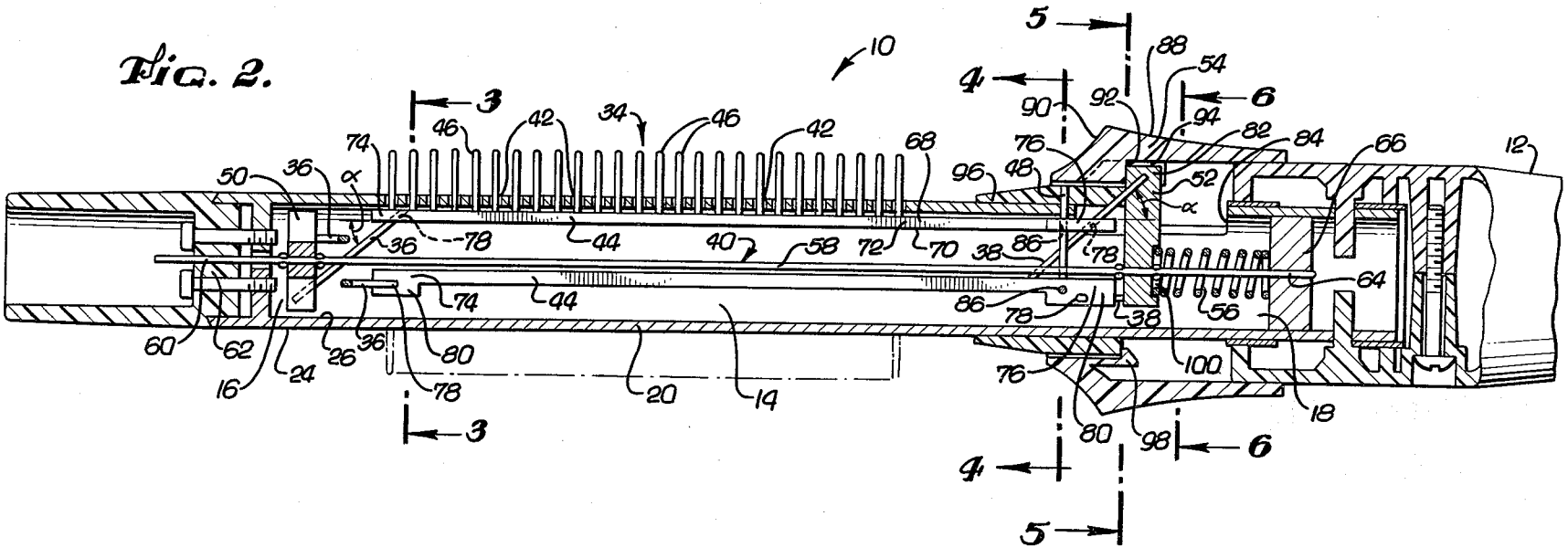
FIG. 2 is an enlarged, fragmentary, sectional view taken substantially along the lines 2—2 of FIG. 1, showing the curling iron with its brushes in a fully extended position.

When the control 54 is released by the user, the bristles 46 are automatically extended by a resilient member 56 positioned within the body 14 to apply a longitudinally inward biasing force on the second end support 50. This biasing force moves the supports 50 and 52 toward the first distal end 16 and returns the actuators 36 and 38 to a position with the bristles 46 fully extended through the wall openings 42 (FIG. 2).

More specifically, the tie member 40 is comprised of a rod 58 positioned within the body 14, in longitudinal coaxial alignment with it, for longitudinal reciprocating movement. The rod 58 has a first end rod portion 60 slidably supported by a first end guide block 62 which is fixedly secured to the body toward its first distal end 16 and beyond the first end support 50, and a second end rod portion 64 slidably supported by a second end guide block 66 which is fixedly secured to the body toward its second distal end 18 and beyond the second end support 52. The guide blocks 62 and 64 also serve to maintain the longitudinal alignment of the rod 58 within the body 14. The rod 58 carries the supports 50 and 52, which are rigidly attached to the rod sufficiently inward from the guide blocks 62 and 66 to allow for the full longitudinal movement of the supports necessary to retract and extend the brushes 34.

In the illustrated embodiment of the invention shown in FIGS. 1–11, the curling iron 10 has four brushes 34, each having a single row of bristles 46 of a predetermined length longitudinally and uniformly spaced along one of the bars 44 and extending at a substantially right angle to the bar. The brushes 34 are symmetrically positioned around the longitudinal axis of the body 14, and the bristles 46 of any one brush extend in an opposite or an orthogonal direction relative to the bristles of the other three brushes.

The wall openings 42, through which the bristles 46 move, are aligned and sized to correspond with the bristles and permit their unrestricted extension and retraction through the side wall 20. It is noted that although the illustrated embodiment has only a single bristle extending through each wall opening, the wall openings could be sized to accommodate several bristles or an entire brush.

Figure 3:
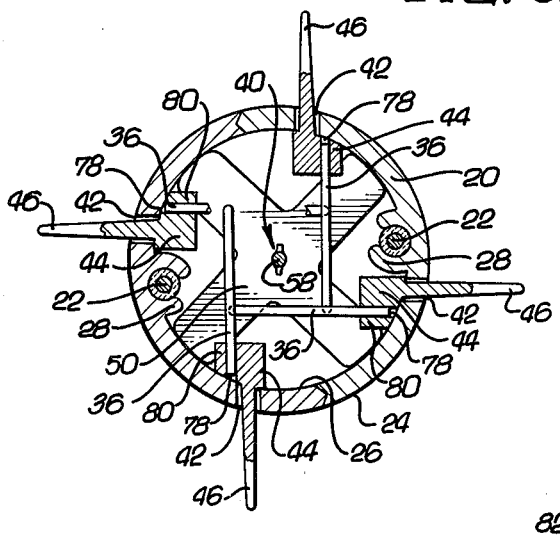
FIG. 3 is an enlarged, fragmentary, sectional view taken substantially along the line 3—3 of FIG. 2.
Figure 8:
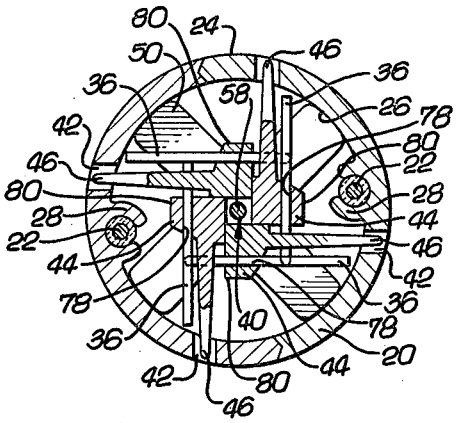
FIG. 8 is an enlarged, sectional view taken substantially along the line 8—8 of FIG. 7.

As shown in FIGS. 3 and 8, to maximize the travel of the brushes 34 within the body 14, and hence the length of the bristles 46 which can be fully retracted into the body clear of its exterior wall surface 24, the bars 44 are positioned and move radially offset from the longitudinal axis of the body by a distance sufficient to prevent the bars from contacting the rod 58 as the brushes are retracted. With each of the bars 44 similarly offset in a uniform manner, the radially inward travel of the bars is not limited by the presence of the rod 58 at the radial center of body 14, and the travel continues until the bars strike against each other.

In the embodiment shown in the drawings, when viewed from the second distal end 18 of the body 14, as is the view of FIGS. 3 and 8, and using the bristles 46 of any one of the bars 44 to prescribe an imaginary vertical reference line, with the radially outward end of the bristles indicating the upward direction, the bars are radially offset to the right of the rod 58. It will be appreciated, however, that the bars 44 could be offset to the left of the rod 58 with equal effectiveness, so long as all bars of the curling iron were similarly offset.

Figure 9:
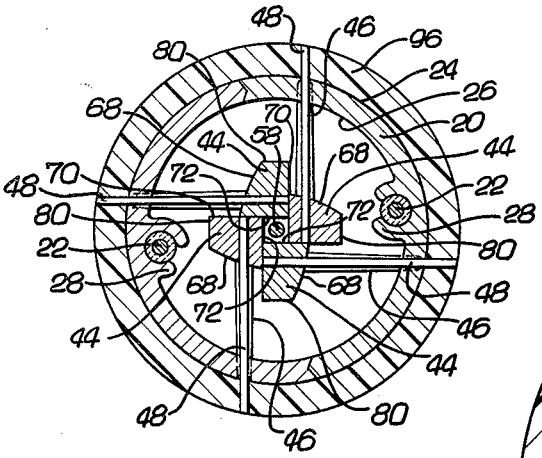
FIG. 9 is an enlarged, sectional view taken substantially along the line 9—9 of FIG. 7.
Figure 10:
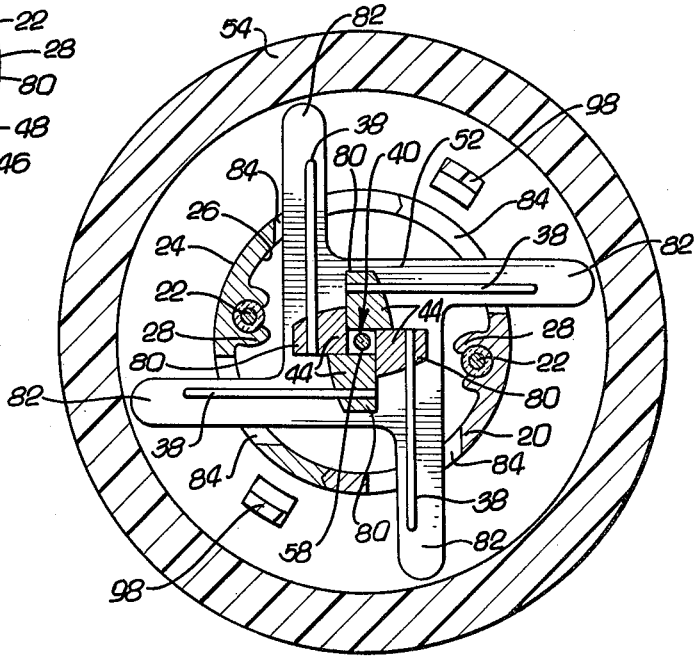
FIG. 10 is an enlarged, sectional view taken substantially along the line 10—10 of FIG. 7.

As shown in FIG. 9, the bars 44 are generally rectangular in cross-section with each having an upper side 68, facing in a generally radially outward direction, to which the bristles 46 are secured, and an opposite lower side 70, facing in a generally radially inward direction. Connecting the upper and lower sides 68 and 70 is an inner side 72 which faces towards the rod 58 when the bars 44 are in the fully retracted position. When in such a position, the lower side 70 of each of the bars 44 abuts the inner side 72 of one of the adjacent bars, with the inner side serving as a stop.

The bars 44 have a first end bar portion 74 and a second end bar portion 76 which slidably engage the first and second end slide actuators 36 and 38, respectively. In the presently preferred embodiment of the invention, the actuators 36 and 38 comprise pins extending longitudinally inward from the first and second end supports 50 and 52 toward the bars 44 at the preselected angle $\alpha$ relative to the bars. The first and second end bar portions 74 and 76 are provided with angled guide holes 78 correspondingly sized and angled to slidably receive the pins. A single pin is used at each of the end portions 74 and 76 of the bars 44. To reduce friction, the bars 44 may be manufactured of zinc or aluminum, and the pins of high tempered steel with a polished surface.

To move the bars 44 in the radially offset manner mentioned above, the actuators 36 and 38 are, of course, also radially offset from the longitudinal axis of the body 14. To avoid interference of the first end actuators 36 with the bristles 46 secured along the first end bar portion 74 of the bars 44, without necessitating lengthening of the bars and hence the body 14, the actuators 36 and 38 engage offset lugs 80 formed as an integral part of the bar at its first and second end bar portions 74 and 76. As view when the brushes are in the fully retracted position (FIGS. 9 and 10), the lugs 80 extend laterally from the bar 44 to the radially outward side of the bristles 46, at a substantially right angle to the bristles, and have the angled guide holes 78 formed therein.

Making specific reference to the view shown in FIG. 7, to avoid interference of the first end support 50 with the travel of the bars 44 when the bars move in a generally radially inward direction for full retraction of the brushes 34, the first end actuator 36 for each bar extends from the support at a point located below the most radially inward travel of the bar experienced, to a point near the interior wall surface 26 of the body 14. Now making specific reference to the view shown in FIG. 2, to avoid interference of the second end support 52 with the travel of the bars 44 when the bars move in a generally radially outward direction for full extension of the brushes 34, the second end actuator 38 for each bar extends from the support at a point located above the most radially outward travel of the bar experienced, to a point adjacent to the rod 58. By eliminating interference of the supports 50 and 52 with the travel of the bars 44, the maximum travel of the bars, and hence retractable bristle length, is achieved.

To support the second end slide actuators 38 at a point located above the most radially outward travel of the bars 44, which is a bar positioned immediately adjacent to the interior wall surface 26 of the body 14, the second end support 52 has a plurality of arms 82 rigidly secured thereto and extending in a generally radially outward direction beyond the side wall 20 through a plurality of slots 84 in the body. The second end actuators 38 are secured to the arms 82 at a point exterior to the body 14, and the slots 84 are sized to permit longitudinal movement of the arms as the second end support 52 moves for extension and retraction of the brushes 34.

The bar guides 48, which restrain longitudinal movement of the bars 44 as the brushes are extended or retracted, comprise pins extending substantially perpendicular to the bars 44. The second end bar portion 76 of each of the bars 44 is provided with a single guide hole 86 positioned and sized to slidably receive one of the pins. As with the pins comprising the actuators 36 and 38, the pins used as the bar guides 48 may be manufactured of high tempered steel with a polished surface to reduce friction.

Figure 6:
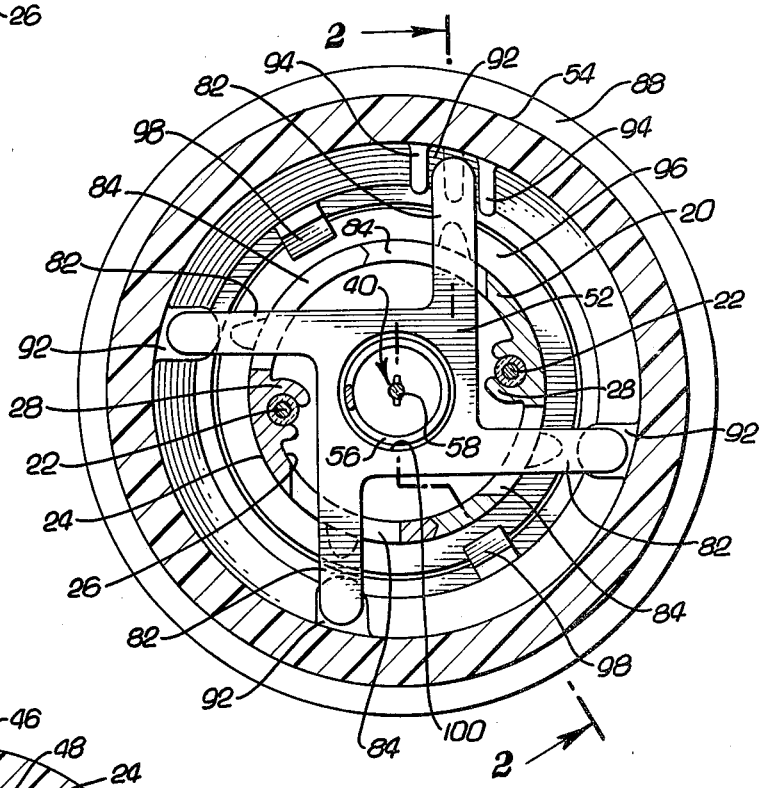
Figure 4:
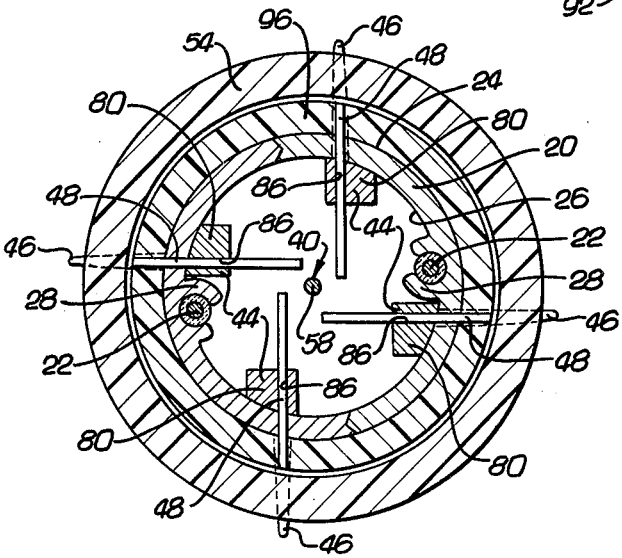
FIG. 4 is an enlarged, sectional view taken substantially along the line 4—4 of FIG. 2.
Figure 5:
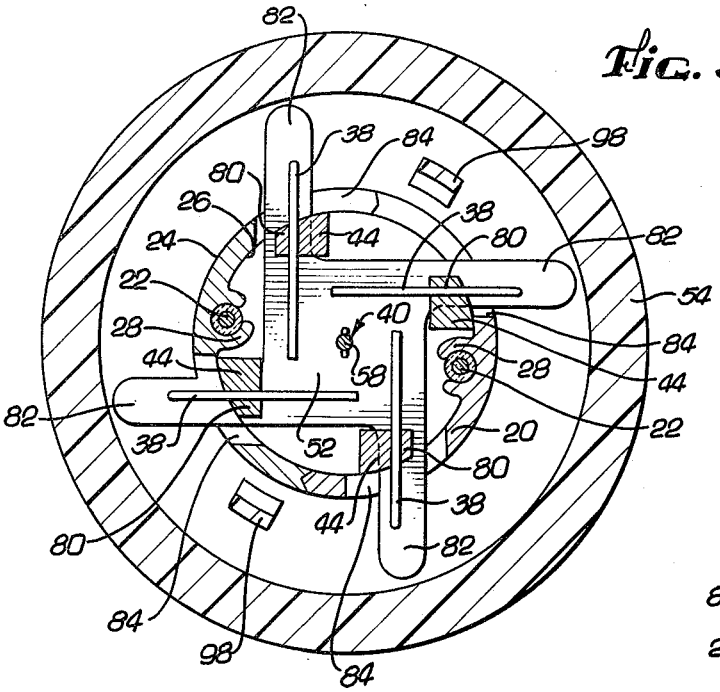
FIG. 5 is an enlarged, sectional view taken substantially along the line 5—5 of FIG. 2.

The control 54 used to retract the brushes 34 comprises a collar 88 slidably disposed around the body 14 and the handle 12, in the vicinity of their attachment to each other. The collar 88 is outwardly flared at its longitudinally inward end to provide an annular gripping surface 90 to facilitate grasping of the collar by the curling iron user. As shown in FIG. 6, the interior of the collar 88 has a plurality of shoulders 92 facing longitudinally outward and positioned to cooperate with the arms 82 of the second end support 52. The shoulders 92 engage the arms 82, and transmit the longitudinally outward force necessary to retract the brushes 34. When the resilient member 56 returns the brushes 34 to the extended position, the arms 82 apply a longitudinally inward force on the shoulders 92 and return the collar 88 to its original position.

Rotation of the collar 88 about the body 14 and handle 12 is prevented by providing one of the shoulders 92 with tabs 94 positioned to each side of the shoulder to limit the rotational movement of the collar relative to the second end support 52. The second end support 52, as well the entire assembly including the supports 50 and 52, the actuators 36 and 38 and the bars 44, are prevented from rotating within the body 14 by the bar guides 48 which are rigidly secured to the body.

To reduce the likelihood of the curling iron user touching the heated body 14 when grasping the gripping surface 90 of the collar 88 for retraction of the brushes 34, an insulated sleeve 96 extends around the body and covers a portion of the body longitudinally inward from the collar. The sleeve 96 also extends partially under the collar 88 to cover that section of the body exposed when the collar is moved for retraction of the brushes 34.

The sleeve 96 also serves as a stop in cooperation with a pair of catches 98, formed as an integral part of the collar 88, which engage the sleeve and limit the longitudinally inward movement of the collar, as is needed with the collar being under the biasing force of the resilient member 56. The sleeve 96 is fixedly secured to the body 14 by the bar guides 48 which extend outward beyond body and into the sleeve.

The resilient member 56 comprises a coil spring positioned along the longitudinal axis of the body 14 around the rod 58, and extending between the second end support 52 and the second end guide block 66. A recess 100 is provided in the second end support 52 to hold one end of the spring in place.

From the foregoing, it will be appreciated that the invention, as described herein for purposes of illustration, provides a hair curling iron with fully and substantially radially retractable bristles which fit within a body of limited diameter while still providing bristles with a sufficient length. It will also be appreciated that, although specific embodiments of the invention have been described herein for purposes of illustration, various modifications may be made without departing from the spirit and scope of the invention. Accordingly, the invention is not limited except as by the appended claims.

I claim:

1. A curling iron comprising:

a handle;

a generally tubular body having a radial side wall with a plurality of wall openings, said body being attached at one end to said handle;

a plurality of brushes extending longitudinally within said body, said brushes having bristles secured thereto and extending in a generally radially outward direction;

at least one selectively operable member disposed within said body for reciprocating longitudinal movement;

and conversion means coacting with said member for converting the reciprocating longitudinal movement of said member into generally radially reciprocating movement of said bristles through said wall openings, whereby the longitudinal movement of the member results in retraction or extension of the brushes.

2. The curling iron of claim 1, wherein said conversion means includes:

a plurality of first end slide actuators positioned toward an end of said body remote from said handle and disposed to move longitudinally with respect to said body, said actuators slidably engaging said brushes at a preselected angle for causing their movement in a generally radial direction in response to the longitudinal movement of said actuators; and a plurality of second end slide actuators positioned toward an end of said body adjacent to said handle and disposed to move longitudinally with respect to said body, said actuators slidably engaging said brushes at said preselected angle for causing their movement in a generally radial direction in response to the longitudinal movement of said actuators, said second end actuators being positioned to cause similarly directed radial movement of said brushes as caused by said first end actuators when said first and second end actuators move in a similar longitudinal direction.

3. The curling iron of claim 2, wherein said conversion means further includes brush guides for restraining the longitudinal movement of said brushes with respect to said body.

4. The curling iron of claim 2, wherein said member is slidably disposed within said body and fixedly secured to said first and second end slide actuators for simultaneously moving said first and second end actuators in said similar longitudinal direction.

5. A curling iron comprising:

a handle;

a generally tubular body having a radial side wall with a plurality of wall openings, said body being attached at one end to said handle;

a plurality of brushes extending longitudinally within said body, said brushes having bristles secured thereto and extending in a generally radially outward direction for reciprocating movement through said wall openings;

a plurality of first end slide actuators positioned toward an end of said body remote from said handle and disposed to move longitudinally with respect to said body, said actuators slidably engaging said brushes at a preselected angle for causing their movement in a generally radial direction in response to the longitudinal movement of said actuators;

a plurality of second end slide actuators positioned toward an end of said body adjacent to said handle and disposed to move longitudinally with respect to said body, said actuators slidably engaging said brushes at said preselected angle for causing their movement in a generally radial direction in response to the longitudinal movement of said actuators, said second end actuators being positioned to cause similarly directed radial movement of said brushes as caused by said first end actuators when said first and second end actuators move in a similar longitudinal direction;

and means for simultaneously moving said first and second end actuators in said similar longitudinal direction, whereby movement of the first and second end actuators results in retraction or extension of the curling iron brushes.

6. The curling iron of claim 5, further including means for restraining longitudinal movement of said brushes with respect to said body as said first and second end actuators move.

7. The curling iron of claim 5, further including means for manually controlling movement of said first and second end actuators in one longitudinal direction for retraction of said bristles through said wall openings.

8. The curling iron of claim 7, further including means for automatically moving said first and second end actuators in an other longitudinal direction for extension of said bristles through said wall openings after being retracted.

9. A curling iron comprising:

a handle;

a generally tubular body having a radial side wall with a plurality of wall openings, said body being attached at one end to said handle;

a plurality of brushes extending longitudinally within said body, said brushes having bristles secured thereto and extending in a generally radially outward direction for reciprocating movement through said wall openings;

a first end support positioned within said body toward an end of said body remote from said handle and beyond said brushes, and disposed to move longitudinally with respect to said body;

a plurality of first end slide actuators fixedly secured to said first end support and slidably engaging said brushes at a preselected angle relative to said brushes for causing their movement in a generally radial direction in response to the longitudinal movement of said first end support;

a second end support positioned substantially within said body toward an end of said body adjacent to said handle and beyond said brushes, and disposed to move longitudinally with respect to said body;

a plurality of second end slide actuators fixedly secured to said second support and slidably engaging said brushes at a preselected angle relative to said brushes for causing their movement in a generally radial direction in response to the longitudinal movement of said second end support, said second end actuators being positioned to cause similarly directed radial movement of said brushes as caused by said first end actuators when said first and second end supports move in a similar longitudinal direction; and means for simultaneously moving said first and second end supports in said similar longitudinal direction.

10. The curling iron of claim 9, further including means for restraining longitudinal movement of said brushes with respect to said body as said first and second end supports move.

11. The curling iron of claim 9, further including means for manually controlling movement of said first and second end supports in one longitudinal direction for retracting said bristles through said wall openings.

12. The curling iron of claim 11, further including means for automatically moving said first and second end supports in an other longitudinal direction for extension of said bristles through said wall openings after being retracted.

13. A curling iron comprising:

a handle;

an elongated, generally tubular body having a first distal end, a second distal end and a radial side wall, said body being rigidly attached at said second end to said handle, and said side wall having a plurality of wall openings;

a plurality of elongated bars extending longitudinally within said body, said bars having bristles of a predetermined length rigidly secured thereto and extending in a generally radially outward direction for reciprocating movement through said wall openings;

a first end support positioned within said body toward said first distal end and beyond said bars, and disposed to move longitudinally with respect to said body;

a plurality of first end actuator pins fixedly secured to said first end support and extending longitudinally inward toward said bars at a preselected angle relative to said bars, said pins slidably engaging the adjacent end portions of said bars for moving said bars in a generally radial direction in response to the longitudinal movement of said first end support;

a second end support positioned substantially within said body toward said second distal end and beyond said bars, and disposed to move longitudinally with respect to said body;

a plurality of second end actuator pins fixedly secured to said second end support and extending longitudinally inward toward said bars at a preselected angle relative to said bars, said pins slidably engaging the adjacent end portions of said bars for moving said bars in a generally radial direction in response to the longitudinal movement of said second end support, said second end actuator pins being positioned to cause similarly directed radial movement of said bars as caused by said first end actuator pins when said first and second end supports move in a similar longitudinal direction; and means for simultaneously moving said first and second end supports in said similar longitudinal direction.

14. The curling iron of claim 13, wherein said means for simultaneously moving said first and second end supports includes a member slidably disposed within said body, in longitudinal, coaxial alignment with said body, said member extending between and fixedly secured to said first and second end supports.

15. The curling iron of claim 14, wherein said bars are positioned radially offset from the longitudinal axis of said body, whereby the radially inward movement of said bars is not limited by the presence of said member.

16. The curling iron of claim 13, further including bar guides positioned within and fixedly secured to said body, said guides extending in a generally radial direction for slidably engaging and restraining longitudinal movement of said bars.

17. The curling iron of claim 13, further including a manually operable collar extending external to said body and engaging said second end support for moving said first and second end supports toward said second distal end for retraction of said bristles through said wall openings.

18. The curling iron of claim 17, further including a resilient member for applying a biasing force on said second end support directed toward said first distal end for automatically returning said first and second end supports to a position with said bristles extended through said wall openings.

19. The curling iron of claim 13, wherein said bars further include offset lugs projecting laterally outward from said bars for slidably engaging said first and second end actuator pins away from the bristles.

20. The curling iron of claim 13, wherein said second end support has a plurality of arms extending generally radially outward beyond said side wall, said second end actuator pins being secured to said arms external of said side wall.

* * * * *